US009277766B2

(12) United States Patent
Chen

(10) Patent No.: US 9,277,766 B2
(45) Date of Patent: Mar. 8, 2016

(54) TABLETOP SEMI-AUTOMATIC CIGARETTE-MAKING MACHINE

(75) Inventor: Junmo Chen, Guangzhou (CN)

(73) Assignee: REPUBLIC TOBACCO L.P., Glenview, IL (US)

( * ) Notice: Subject to any disclaimer, the term of this patent is extended or adjusted under 35 U.S.C. 154(b) by 544 days.

(21) Appl. No.: 13/563,129

(22) Filed: Jul. 31, 2012
(Under 37 CFR 1.47)

(65) Prior Publication Data

US 2014/0034069 A1 Feb. 6, 2014

(51) Int. Cl.
*A24C 5/00* (2006.01)
*A24C 5/06* (2006.01)

(52) U.S. Cl.
CPC ..... *A24C 5/06* (2013.01)

(58) Field of Classification Search
CPC ..... A24C 5/06; A24C 5/42
USPC ..... 131/70–75
See application file for complete search history.

(56) References Cited

U.S. PATENT DOCUMENTS

| | | | | |
|---|---|---|---|---|
| 2,551,095 | A * | 5/1951 | Chaze | 222/162 |
| 3,298,375 | A * | 1/1967 | Petri et al. | 131/81.1 |
| 3,886,952 | A * | 6/1975 | Kastner | 131/70 |
| 4,230,132 | A | 10/1980 | Crisp | |
| 5,088,506 | A * | 2/1992 | Kastner | 131/70 |
| 6,739,343 | B1 | 5/2004 | Trinkies et al. | |
| 8,261,752 | B2 | 9/2012 | Bao | |
| 2006/0096604 | A1* | 5/2006 | Moser et al. | 131/70 |
| 2008/0156335 | A1* | 7/2008 | Bajouet | 131/70 |
| 2009/0183741 | A1* | 7/2009 | Lin | 131/70 |
| 2010/0229880 | A1* | 9/2010 | Bao | 131/70 |

FOREIGN PATENT DOCUMENTS

| | | | |
|---|---|---|---|
| CN | 201138314 | Y | 10/2008 |
| CN | 101986903 | A | 3/2011 |
| CN | 101606755 | B | 11/2011 |
| EP | 0144460 | A1 | 6/1985 |
| GB | 2503327 | A | 12/2013 |
| WO | 2007/125425 | A2 | 11/2007 |
| WO | 2011/127500 | A1 | 10/2011 |

OTHER PUBLICATIONS

Office Action issued in related application CN201310340216.8, dated Jan. 6, 2015, with English translation, 17 pages.

(Continued)

*Primary Examiner* — Richard Crispino
*Assistant Examiner* — Yana B Krinker
(74) *Attorney, Agent, or Firm* — Michael Best & Friedrich LLP

(57) ABSTRACT

A semi-automatic cigarette-making machine of the tobacco-injecting type including a housing with an aperture and a compacting chamber in communication with the aperture for receiving loose tobacco, a compacting member mounted for manual reciprocal up and down motion from an initial position adjacent the top of the compacting chamber toward the bottom of the compacting chamber in response to the rotation of a pair of opposed gears, and an injection spoon mounted for automatic powered reciprocal lateral movement from a rest position within the compacting chamber across the compacting chamber to transport rod-like compacted tobacco shapes past the ejection side of the compacting chamber and into a hollow cigarette tube.

21 Claims, 6 Drawing Sheets

(56) References Cited

OTHER PUBLICATIONS

Preliminary search report and written opinion issued in related application FR1357543, dated Jan. 20, 2015, with English translation, 9 pages.

Examination report issued in related application GB1313179.2, dated Feb. 12, 2015, 3 pages.

Search report and office action issued in related application HU P1300453, dated Jan. 28, 2015, with partial translation, 6 pages.

* cited by examiner

TABLETOP SEMI-AUTOMATIC CIGARETTE-MAKING MACHINE

FIELD

This invention pertains generally to injector-type cigarette-making machines, and, more particularly, to compact tabletop semi-automatic injector-type cigarette-making machines and methods of using such cigarette-making machines.

BACKGROUND

Manual injector-type cigarette-making machines are well known. Such cigarette-making machines are typically operated by rotating a crank to first compress a selected portion of loose tobacco equivalent to one cigarette within a compaction chamber and then to inject the compressed tobacco into a pre-formed cigarette tube by means of a device that carries the tobacco into the tube. The pre-formed empty cigarette tube is held at one end of a hollow nipple of the cigarette-making machine during the injection of the compressed tobacco. Once the compressed tobacco is in place in the pre-formed cigarette tube, the tube is released from the cigarette-making machine to be smoked or stored for later use.

Many of the prior manual injector-type cigarette-making machines are considered slow and cumbersome to use, particularly when it is desired to make a substantial number of cigarettes. Many current automatic machines, on the other hand, are typically large, complex, expensive and difficult to use, making them impractical for individuals making cigarettes for their own use. Also, many of these complex and expensive automatic cigarette-making machines require careful calibration and produce many less than optimal cigarettes in terms of tube fill and tobacco uniformity. Furthermore, complex prior art automatic cigarette-making machines are vulnerable to breakdown and expensive repairs.

It is therefore an object of the present invention to provide a compact, economical, semi-automatic cigarette-making machine that consistently and efficiently produces cigarettes using a mechanism that is neither complex nor requires adjustment or expensive repairs.

SUMMARY

Embodiments of the invention relate to a semi-automatic cigarette-making machine having a housing with an aperture in its surface for receiving loose tobacco, a delivery side with exit port and a rotary handle for operating the cigarette-making machine. Preferably the handle is mounted for reciprocal motion in a vertical plane. The machine includes a compacting chamber in communication with the aperture for receiving loose tobacco. The machine may have a funnel with curved inclined sides for directing loose tobacco into the aperture and the compacting chamber.

A compacting member is mounted for manually operated reciprocal up and down motion from an initial position adjacent the top of the compacting chamber toward the bottom of the compacting chamber. The compacting member thus compacts loose tobacco in the compacting chamber into a rod-like shape at the bottom of the chamber.

The handle is affixed to a laterally disposed rotatably mounted shaft which has a spur gear perpendicularly disposed on the shaft with circumferential gear teeth for engaging a slidably mounted rack gear mounted and for reciprocal movement coincident with the direction of movement of the reciprocating compacting member. The rack gear has a series of gear teeth running along it's bottom surface that are shaped, dimensioned and positioned to engage the gear teeth of the spur gear.

The rack gear includes lateral teeth that extend from at least one edge of the rack gear and are structured, dimensioned and disposed to engage gear teeth of at least one spur gear that is linked to the reciprocating compacting member to move the compacting member as the rack gear is moved by operation of the spur gear. Preferably the rack gear will have lateral gear teeth extending from both opposite edges of the rack gear and a pair of opposed spur gears structured, dimensioned and disposed to engage these lateral gear teeth.

An injection spoon is positioned adjacent to the bottom of the compacting chamber. Preferably both the injection spoon and the compacting member will have concave surfaces to help form the top of the compacted tobacco rod-like shape. The injection spoon is mounted for reciprocal movement across the compacting chamber to transport the rod-like shape through the exit port in the delivery side of the compacting chamber. An electrically powered motor coupled to the injection spoon moves the spoon across the chamber.

The automatic phase of the machine is achieved by initiating the operation of the electric motor when the handle and shaft reach a pre-set rotation at the end of the manual operation phase. Thus, an injection spoon drive arm is attached to the injection spoon adjacent to the distal end of the arm and mounted for a reciprocal motion about the proximal end of the arm as the motor is operated. The motor includes a drive link with an upwardly directed drive pin and the injection spoon arm includes a longitudinal slot. The pin is located in the slot so that the rotation of the motor drives the reciprocal motion of the injection spoon and the reciprocal lateral movement of the injection spoon across the compacting chamber. Preferably the pin will be a bearing-mounting rotatable pin.

A switch member is affixed to the injection spoon drive arm for triggering a switch to operate an electronic control reversing the operation of the motor and returning the injection spoon drive arm and the injection spoon to their rest position after the injection spoon moves across the compacting chamber.

Embodiments of the invention also include methods of operating the cigarette-making machine described above.

DRAWINGS

DETAILED DESCRIPTION OF EXEMPLARY EMBODIMENTS

The embodiments described below are not intended to be exhaustive or to limit the invention to the structure and operation disclosed. Rather, the described embodiments have been chosen to help explain embodiments of the invention and its application, operation and use in order to best enable others skilled in the art to follow its teachings.

Figure 1:
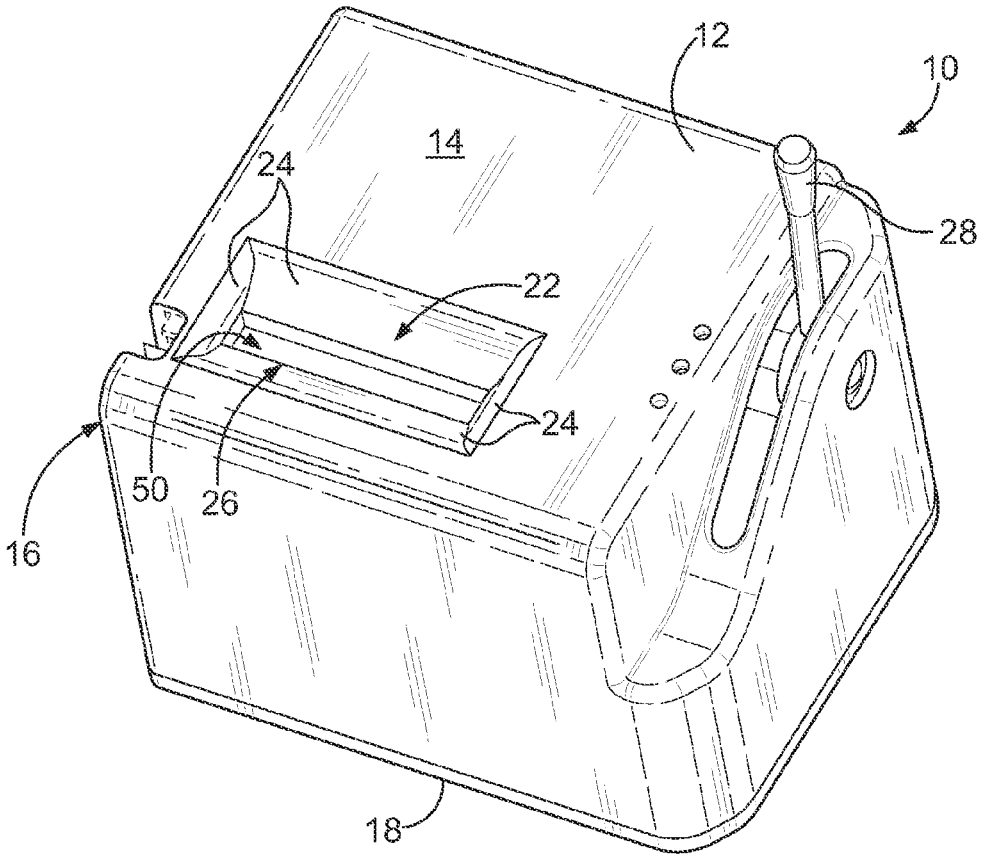
FIG. 1 is a perspective view of a tabletop semi-automatic cigarette-making machine embodiment with the mechanism of the device covered by a cover.

Referring now to the Figures, tabletop semi-automatic cigarette-making machine embodiments are provided. In FIG. 1, the exterior of a tabletop semi-automatic cigarette-making machine embodiment 10 is shown, with the mechanism of the device covered by a cover 12. This cover may, of course, be made of any suitable material, such as plastic, metal, etc. Cover 12 includes a top surface 14, four vertical sides, including a delivery side 16 and a bottom 18. Delivery side 16 may also include a slot for a retractable tray 20 (FIG. 1A) to receive finished cigarettes.

Top surface 14 has a funnel portion 22 for receiving loose tobacco with curved inclined sides 24 for directing the loose tobacco toward a compacting chamber access opening 26. The cigarette-making machine also includes a handle 28 which operates in a vertical plane and is used in manually initiating the first (manual) step in the cigarette making process followed by the second (automatic) step, as will be explained below.

A tobacco compacting chamber 50 lies beneath opening 26 as shown in FIG. 1. Thus, before the cigarette-making machine is put into operation to form a cigarette, loose tobacco intended for the cigarette is placed in funnel portion 22 to be directed through compacting chamber access opening 26 into the compacting chamber.

Figure 2:
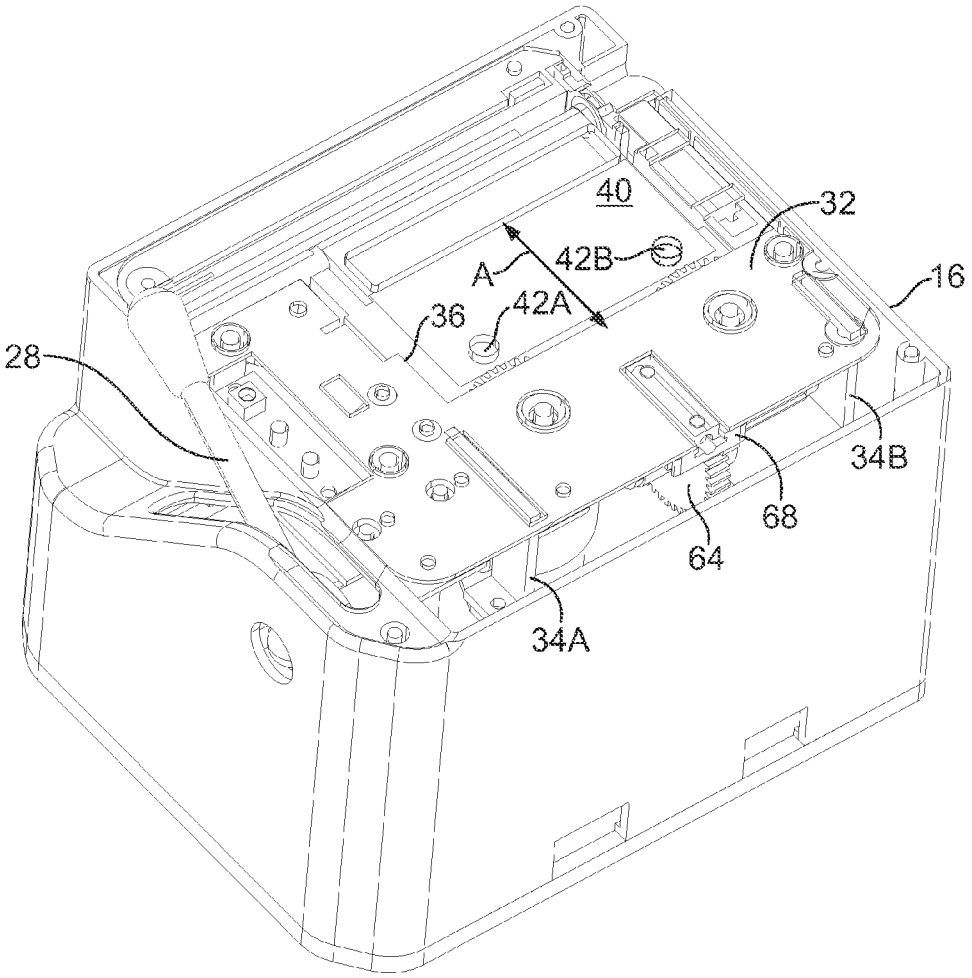
FIG. 2 is an perspective view of the cigarette-making machine embodiment of FIG. 1 which the top surface of the cover has been removed to expose a top support plate and some of the internal workings of the device.

In FIG. 2 the top surface of the plastic cover has been removed to expose some of the internal workings of the device. A top support plate 32 which is held in place by appropriate brackets, including brackets 34A and 34B, can be seen in this view. Selected operating components of the machine are mounted to the support plate. Top support plate 32 has a cut-out 36 through which a reciprocating compacting member 40 can be seen in this view. The compacting member includes two bores 42A and 44B at which drive arms 44 and 46 (which are discussed below) are rotatably attached. The reciprocating compacting member is arranged to move or reciprocate in direction "A" so that its leading edge 48 moves between the top edge 52 of compacting chamber 50 and its bottom edge 54. Leading edge 48B of the reciprocating compacting member has a concave compacting surface.

Figure 3:
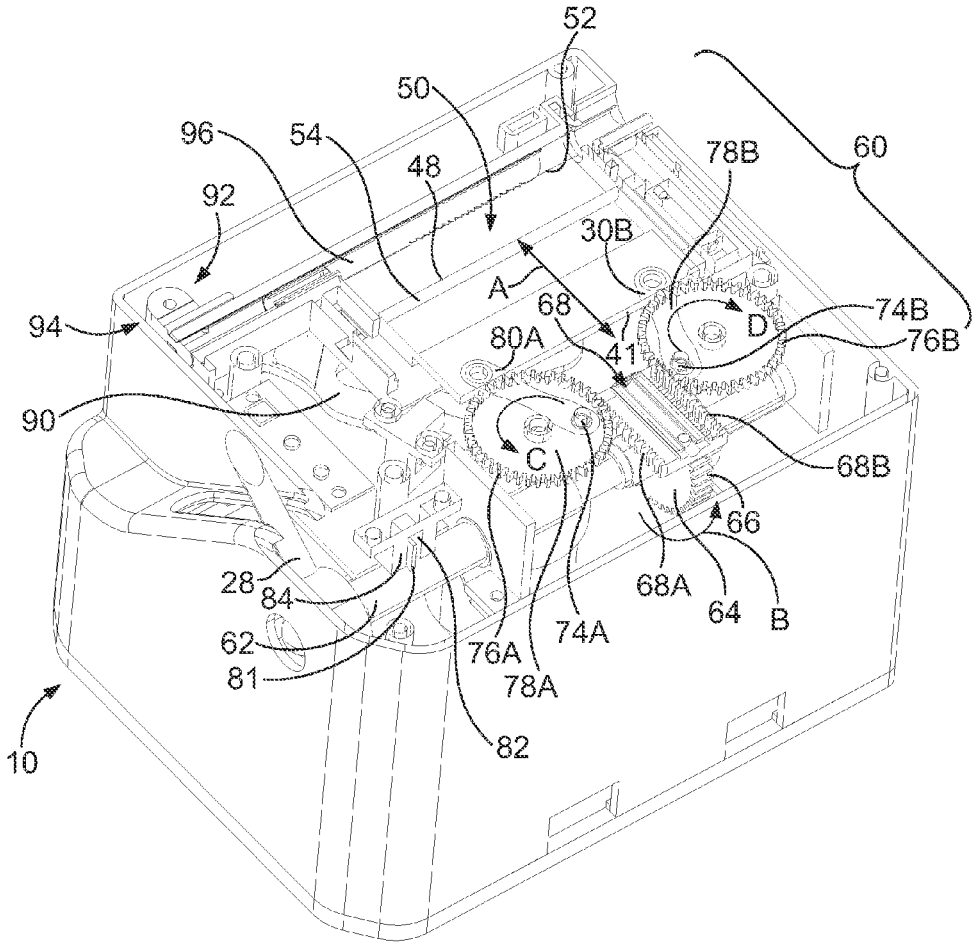
FIG. 3 is a further perspective view of the cigarette-making machine embodiment of FIG. 2 in which the top support plate has been removed in order to better examine the compacting drive mechanism of the machine.
Figure 3A:
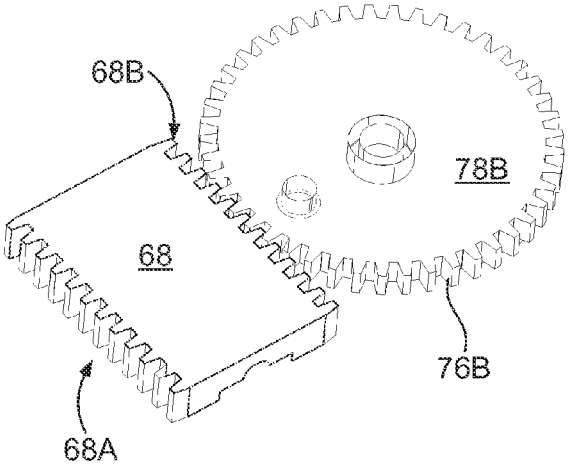
FIG. 3A is an enlarged perspective view of a rack gear employed in the cigarette-making machine embodiment of FIG. 1 meshing along its edge with gear teeth disposed about the circumference of a spur gear.

In FIG. 3 support plate 32 has been removed in order to better examine the compacting drive mechanism 60 of the cigarette-making machine. As can be seen in this figure, this mechanism includes handle 28 which is perpendicularly affixed to a laterally disposed rotatably mounted shaft 62. Shaft 62 includes, fixed to the shaft, a vertically disposed spur gear 64 with circumferential gear teeth 66 that are disposed opposite a rack gear plate 68 which can also be seen in FIG. 3A. The rack gear is slidably mounted in top support plate 32 so that it moves reciprocally in direction "A" coincident with the direction of movement of the reciprocating compacting member.

Figure 3B:
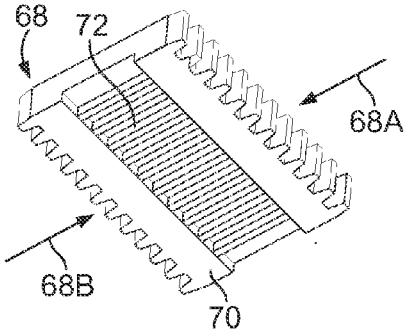
FIG. 3B is a bottom perspective view of the rack gear of FIG. 3A showing additional gear teeth running along the bottom center portion of the rack gear.

As can be seen in FIG. 3B, rack gear 68 includes a generally flat bottom surface 70 with a series of gear teeth 72 running along its longitudinal center. These gear teeth are shaped, dimensioned and positioned to engage gear teeth 66 of vertically disposed spur gear 64 (FIG. 3). Additionally, lateral gear teeth 68A and 68B extend from the edges of the rack gear. Gear teeth 68A and 68B are structured, dimensioned and disposed to engage gear teeth 74 and 76 of a pair of opposed spur gears 75A and 76B which are rotatably mounted to the support plate.

Additionally, a pair of links 80A and 80B are rotatably mounted at their proximal ends respectively to the top surfaces of opposed gear wheels 78A and 78B at attachment points 74A and 74B. The opposite distal ends of each of the links is in turn rotatably attached at bores 42A and 42B (FIG. 3) of reciprocating compacting member 40 adjacent its proximal top edge 41.

Thus, as handle 28 is rotated downwardly, gear spur 64 rotates in direction "B." Since gear teeth 66 of the gear engage gear teeth 72 of rack gear 68, this motion produced under the manual operation (downward movement) of the handle causes the rack gear to move forward toward the compacting chamber. The forward movement of the rack gear in turn causes opposed spur gears 78A and 78B to rotate in opposing directions C and D. This opposing rotation of the opposed spur gears rotates connection points 74A and 74B of links 80A and 80B forward (or toward the reciprocating compacting member) causing the links in turn to move forward driving the reciprocating compacting member down against the tobacco in compacting chamber 50. As a result, the tobacco in the chamber then is formed into a rod-like shape between the concave compacting surface of the reciprocating member and the half-round surface of injection spoon 96. And, under this direct geared action an unusually smooth and evenly disposed compacting force is applied across leading edge 48 of the compacting member to insure reliable movement perpendicular to direction "A", proper uniform tobacco compaction, and the production of a rod-like shape with uniform burning characteristics.

Figure 4:
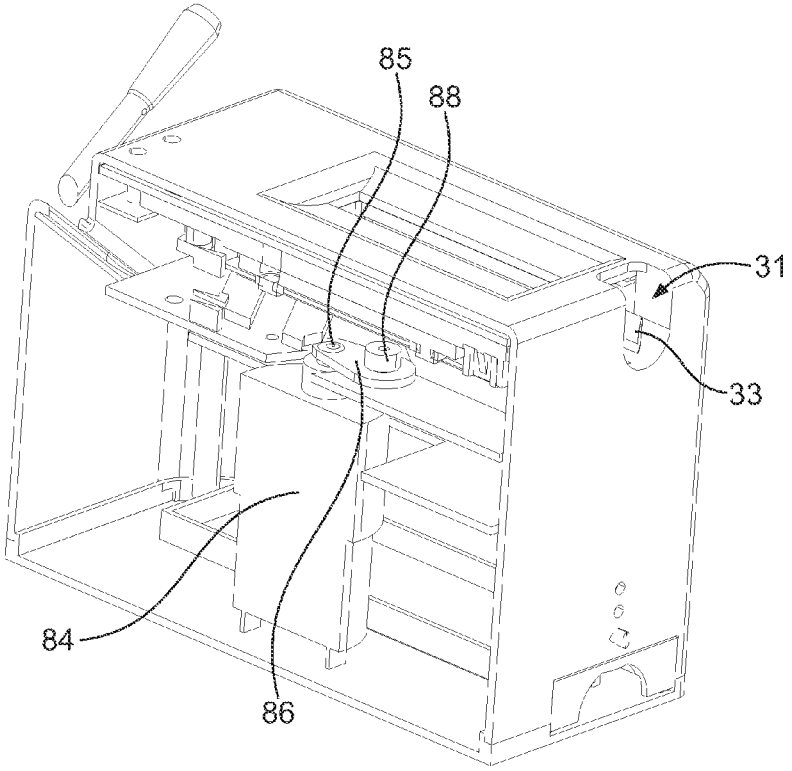
FIG. 4 is a back perspective cutaway view of the semi-automatic cigarette-making machine embodiment of FIG. 1 showing an electric motor which partially powers the machine and an associated linkage.
Figure 5:
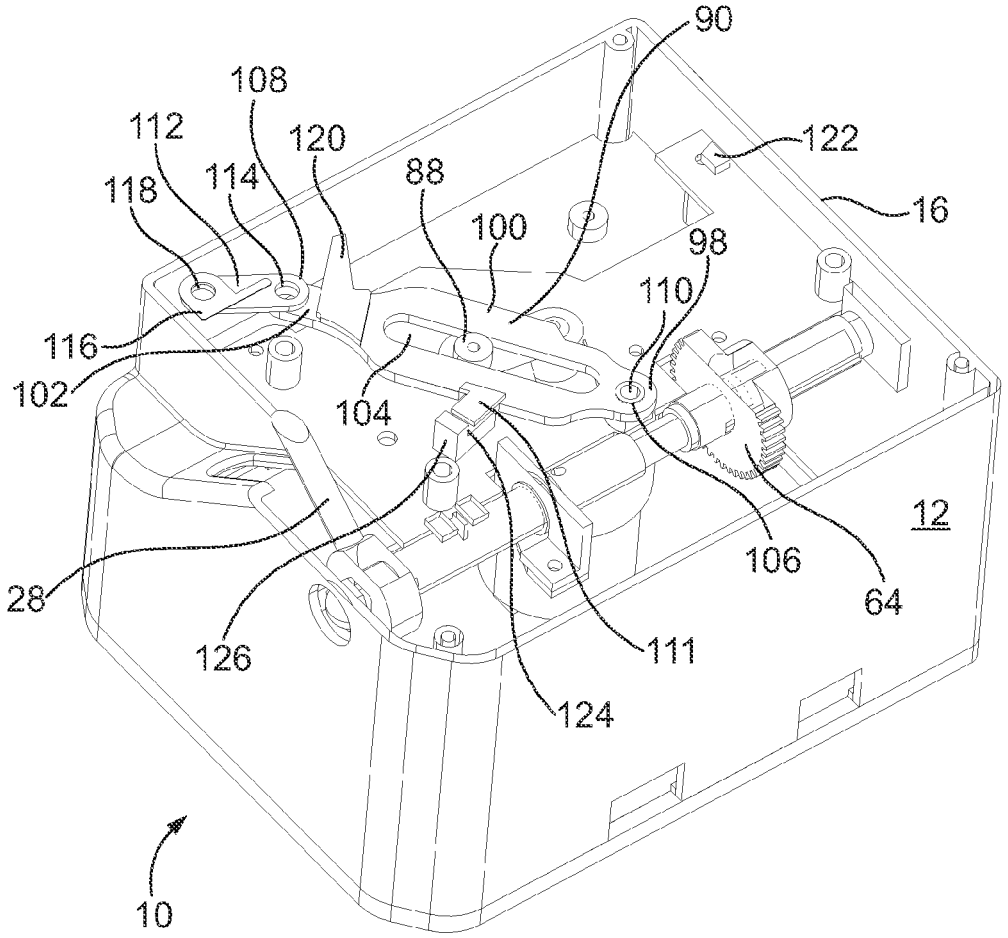
FIG. 5 is a perspective view of the semi-automatic cigarette-making machine embodiment of FIG. 1 in which the top surface of the cover as well as the top support plate and the compacting drive mechanism have been removed to enable closer inspection of the componentry that is activated during the automatic phase of operation.

After handle 28 and shaft 62 are rotated to achieve the desired compacting of the tobacco in the compacting chamber, trigger member 81 on shaft 62 enters a sensing cavity 82 in switch 84 triggers a switch which supplies electrical energy to electrical motor 84 shown in this FIG. 4 causing the motor shaft 85 to rotate. This initiates the "automatic" phase of the operation of the cigarette-making machine by way of the motor driven rotation of a drive link 86 is affixed to the motor shaft 85. As shown in FIGS. 4 and 5, the drive link includes an upwardly directed drive pin 88 at the distal end of the link. Pin 88 preferably is a bearing-mounted rotatable pin to minimize friction as the pin moves in slot 104 as discussed below.

During this automatic phase of the operation of the cigarette-making machine, an injection spoon drive arm 90 is reciprocated to operate an injection spoon 96. As shown in FIG. 5, the injection spoon drive arm is connected to an injection spoon assembly affixed to injection spoon link 116 through a pivoting link 112 rotatably attached at bore 108 to the injection spoon drive arm and at bore 118 to the injection spoon link. Tracking means (not shown) are provided to confine the movement of the injection spoon assembly to reciprocal lateral movement from a rest position within the compacting chamber across compacting chamber 50 and back. The approximately half round open tubular injection spoon 96 projects from the injection spoon assembly. The radius of curvature of this open tubular spoon is approximately the same as that of the front compacting edge of the reciprocating compacting member.

The injection spoon drive arm has a proximal end section 98, a mid-section 100 and a distal section 102. Mid-section 100 includes a longitudinal slot 104 and the proximal and distal end sections include respective bores 106 and 108. The injection spoon drive arm is rotatably fixed to a pin 110 so that the injection spoon drive arm can reciprocate back and forth about the pin.

Figure 1A:
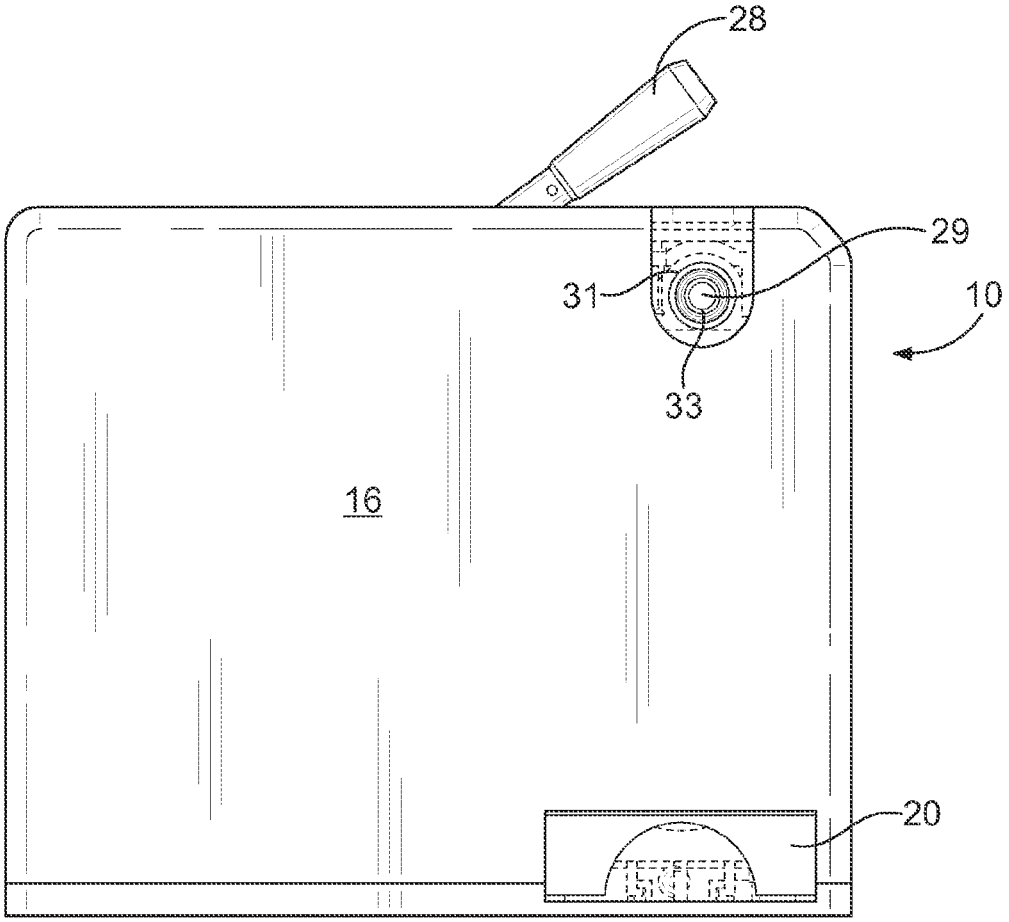
FIG. 1A is a side elevation view of the cigarette-making machine embodiment of FIG. 1.

This reciprocal motion is achieved by way of drive pin 88 which is positioned and dimensioned for sliding movement in slot 104. Thus, as drive link 86 affixed to motor shaft 84 rotates in a clockwise direction in the illustrated embodiment, pin 88 moves along the slot causing the distal end of the injection spoon drive arm and hence the injection spoon assembly including injection spoon 96 to move toward delivery side 16 of cigarette-making machine to deliver a rod-like tobacco shape carried by the injection spoon into a hollow cigarette tube (not shown) positioned opposite delivery port 29. When the injection spoon drive arm reaches the end of its motion a switch member 120 affixed to the injection spoon drive arm enters into a sensing cavity of a switch 122 by which appropriate electronic circuitry is triggered to cause the motor to reverse direction, withdrawing the injection spoon from the cigarette tube and returning it to the rest position illustrated, for example, in FIG. 3. A cigarette tube holding mechanism 31 may be provided as can be seen in FIGS. 1A and 4, including a pressure applying member 33 which engages and retains cigarette tubes on nipple 33 while the compaction and injection process proceeds.

In another aspect, a method of using the improved injector-type cigarette-making machine is provided. First, a paper cigarette tube is disposed on the nipple of the tube holding mechanism. Then, an appropriate quantity of loose tobacco is placed in funnel portion 22 and pressed into tobacco compacting chamber 26. Once the tube and tobacco are properly in place, the user moves handle 28 which causes gear 64 to rotate forward driving rack gear 68 forward. Rack gear 68 in turn engages opposed gears 75A and 75B which rotate in opposite directions to move links 80A and 80B forward. Since these links are rotatably attached to reciprocating compacting member 50, the compacting member is driven forward under a smooth and evenly disposed compacting force that is applied across the leading edge of the compacting member to complete the manual phase of the operation of the device. This ensures reliable perpendicular movement of the compacting member as well as the production of proper uniform tobacco compaction and a rod-like shape which, once disposed within a hollow cigarette tube, will have uniform burning characteristics.

At a preset rotation of the handle, electrical power is supplied to a motor to initiate the automatic phase of the operation of the device. The motor shaft rotates a drive link having a drive pin at its distal end. The drive link is positioned in a longitudinal slot of the injection spoon drive arm. The arm itself is rotatably affixed at its distal end and linked to an injection spoon assembly mounted for lateral movement across the compacting chamber of the device. As the drive link rotates clockwise its pin moves along slot in the injection spoon drive arm causing the distal end of the injection spoon drive arm and hence the injection spoon assembly to move toward delivery side 16 of the cigarette-making machine to deliver the rod-like tobacco carried by the injection spoon into the hollow cigarette tube positioned opposite the delivery port of the device.

When the injection spoon drive arm reaches the end of its motion appropriate electronic circuitry is triggered to cause the motor to reverse direction and withdraw the injection spoon from the cigarette to its rest position. Handle 28 may then be returned to its rest position, as illustrated in FIG. 1. This completes a single cycle of the operation of the device to complete the formation of a tobacco filled cigarette tube.

The use of the terms "a" and "an" and "the" and similar referents in the context of describing embodiments of the invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of embodiments the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A semi-automatic cigarette-making machine comprising:

a housing including a surface having an aperture for receiving loose tobacco, a delivery side with an exit port and a rotary handle for operating the cigarette-making machine;

a compacting chamber in communication with the aperture for receiving loose tobacco;

a compacting member mounted for manually operated reciprocal up and down motion from an initial position adjacent the top of the compacting chamber toward the bottom of the compacting chamber to compact loose tobacco in the compacting chamber into a rod-like tobacco shape at the bottom of the compacting chamber, the handle being affixed to a laterally disposed rotatably mounted shaft for operating a pair of gears to move the compacting member reciprocally up and down from the initial position toward the bottom of the compacting chamber;

an injection spoon for transporting the rod-like tobacco shape mounted for reciprocal lateral movement across the compacting chamber;

an electrically powered motor coupled to the injection spoon to move the injection spoon across the compacting chamber to transport the rod-like compacted tobacco shape through the exit port in the delivery side of the compacting chamber into a hollow cigarette tube positioned opposite the port; and a first spur gear perpendicularly disposed on the rotary handle shaft with vertically disposed circumferential gear teeth for engaging a rack gear slidably mounted for reciprocal movement coincident with the direction of movement of the reciprocating compacting member, the rack gear having a series of gear teeth running along its bottom surface shaped, dimensioned and positioned to engage the gear teeth of the first spur gear and lateral gear teeth extending from opposite edges of the rack gear structured, dimensioned and disposed to engage the gear teeth of a pair of adjacent spur gears linked to the reciprocating compacting member to move the compacting member as the rack gear is moved by operation of the spur gears.

2. The semi-automatic cigarette-making machine of claim 1 including a funnel with curved inclined sides for directing loose tobacco into the compacting chamber.

3. The semi-automatic cigarette-making machine of claim 1 in which the handle is mounted for reciprocal motion in a vertical plane.

4. The semi-automatic cigarette-making machine of claim 1 including means for initiating the automatic phase of the operation of the cigarette-making machine by beginning operation of an electrical motor when the handle and shaft reach a preset rotation.

5. The semi-automatic cigarette-making machine of claim 4 including an injection spoon drive arm attached to the injection spoon adjacent its distal end and mounted for reciprocal motion about its proximal end as the motor is operated.

6. The semi-automatic cigarette-making machine of claim 5 in which the motor includes a drive link with an upwardly directed drive pin, the injection spoon drive arm includes a longitudinal slot, and the pin is located in the slot so that rotation of the motor drives the reciprocal motion of the injection spoon arm and the reciprocal lateral movement of the injection spoon across the compacting chamber.

7. The semi-automatic cigarette-making machine of claim 6 in which the pin is a bearing-mounted rotatable pin.

8. The semi-automatic cigarette-making machine of claim 4 including a switch member affixed to the injection spoon drive arm for triggering a switch to operate an electronic control to reverse the operation of the motor and return the injection spoon drive arm and the injection spoon to their rest position after the injection spoon moves across the compacting chamber.

9. The semi-automatic cigarette-making machine of claim 1 including a tube holding mechanism for retaining cigarette tubes on a nipple in communication with the compacting chamber extending from the port on the delivery side of the compacting chamber.

10. The cigarette-making machine of claim 1 in which the compacting member includes a leading concave compacting edge to help form the top of the compacted rod-like tobacco shape.

11. A semi-automatic cigarette-making machine comprising:

a housing including a surface having an aperture for receiving loose tobacco, a delivery side with an exit port and a shaft-mounted rotary handle for operating the cigarette-making machine;

a compacting chamber in communication with the aperture for receiving loose tobacco;

a compacting member mounted for manually operated reciprocal up and down motion from an initial position adjacent the top of the compacting chamber toward the bottom of the compacting chamber to compact loose tobacco in the compacting chamber into a rod-like tobacco shape at the bottom of the compacting chamber;

an injection spoon for transporting the rod-like tobacco shape mounted for reciprocal lateral movement across the compacting chamber;

an electrically powered motor coupled to the injection spoon to move the injection spoon across the compacting chamber to transport the rod-like tobacco shape through the exit port in the delivery side of the compacting chamber into a hollow cigarette tube positioned opposite the port;

means for initiating the automatic phase of the operation of the cigarette-making machine by beginning operation of an electrical motor when the handle and shaft reach a preset rotation; and a switch member affixed to the injection spoon drive arm for triggering a switch to operate an electronic control to reverse the operation of the motor and return the injection spoon drive arm and the injection spoon to their rest position after the injection spoon moves across the compacting chamber.

12. The semi-automatic cigarette-making machine of claim 11 including a funnel with curved inclined sides for directing loose tobacco into the compacting chamber.

13. The semi-automatic cigarette-making machine of claim 11 in which the handle is affixed to a laterally disposed rotatably mounted shaft for operating a pair of gears to move the compacting member reciprocally up and down from the initial position toward the bottom of the compacting chamber.

14. The semi-automatic cigarette-making machine of claim 11 including a tube holding mechanism for retaining cigarette tubes on a nipple in communication with the compacting chamber extending from the port on the delivery side of the compacting chamber.

15. The cigarette-making machine of claim 11 in which the compacting member includes a leading concave compacting edge to help form the top of the compacted rod-like tobacco shape.

16. A semi-automatic cigarette-making machine comprising:

a housing including a surface having an aperture for receiving loose tobacco, a delivery side with an exit port and a shaft-mounted rotary handle for operating the cigarette-making machine;

a compacting chamber in communication with the aperture for receiving loose tobacco;

a compacting member mounted for manually operated reciprocal up and down motion from an initial position adjacent the top of the compacting chamber toward the bottom of the compacting chamber to compact loose tobacco in the compacting chamber into a rod-like tobacco shape at the bottom of the compacting chamber;

an injection spoon for transporting the rod-like tobacco shape mounted for reciprocal lateral movement across the compacting chamber;

an electrically powered motor coupled to the injection spoon to move the injection spoon across the compacting chamber to transport the rod-like compacted tobacco shape through the exit port in the delivery side of the compacting chamber into a hollow cigarette tube positioned opposite the port, the motor including a drive link with an upwardly directed drive pin;

means for initiating the automatic phase of the operation of the cigarette-making machine by beginning operation of an electrical motor when the handle and shaft reach a preset rotation; and an injection spoon drive arm attached to the injection spoon adjacent its distal end mounted for reciprocal motion about its proximal end as the motor is operated, the injection spoon drive arm including a longitudinal slot, and the pin is located in the slot so that rotation of the motor drives the reciprocal motion of the injection spoon arm and the reciprocal lateral movement of the injection spoon across the compacting chamber.

17. The semi-automatic cigarette-making machine of claim 16 including a funnel with curved inclined sides for directing loose tobacco into the compacting chamber.

18. The semi-automatic cigarette-making machine of claim 16 in which the handle is affixed to a laterally disposed rotatably mounted shaft for operating a pair of gears to move the compacting member reciprocally up and down from the initial position toward the bottom of the compacting chamber.

19. The semi-automatic cigarette-making machine of claim 18 including a first spur gear perpendicularly disposed on the rotary handle shaft with vertically disposed circumferential gear teeth for engaging a rack gear slidably mounted for reciprocal movement coincident with the direction of movement of the reciprocating compacting member.

20. The semi-automatic cigarette-making machine of claim 19 in which the rack gear has a series of gear teeth running along its bottom surface shaped, dimensioned and positioned to engage the gear teeth of the first spur gear.

21. The semi-automatic cigarette-making machine of claim 16 including a tube holding mechanism for retaining cigarette tubes on a nipple in communication with the compacting chamber extending from the port on the delivery side of the compacting chamber.

* * * * *